United States Patent [19]

Otsuka et al.

[11] Patent Number: 4,810,285

[45] Date of Patent: Mar. 7, 1989

[54] PROCESS FOR PREPARING SPHERICAL COPPER FINE POWDER

[75] Inventors: Kenichi Otsuka; Minoru Nitta, both of Chiba, Japan

[73] Assignee: Kawasaki Steel Corporation, Hyogo, Japan

[21] Appl. No.: 170,349

[22] Filed: Mar. 18, 1988

[51] Int. Cl.[4] ..... B22F 9/12
[52] U.S. Cl. ..... 75/0.5 B
[58] Field of Search ..... 75/0.5 B

[56] References Cited

PUBLICATIONS

Funtai Kogaku-Kaishi, vol. 21, pp. 759-767, 1984.

*Primary Examiner*—Wayland Stallard
*Attorney, Agent, or Firm*—Parkhurst, Oliff & Berridge

[57] ABSTRACT

In a process for preparing a spherical copper fine powder having an average grain size ranging from 0.1 μm to a few μm, by use of chemical vapor deposition of cuprous chloride vapor with a reducing gas, the vapor deposition zone is maintained at a temperature ranging 900° C. to less than 1,150° C. and the generated particles are quenched subsequently. The generated powder is utilized as a conductive powder which is the main component of a conductive paste.

3 Claims, 2 Drawing Sheets

PROCESS FOR PREPARING SPHERICAL COPPER FINE POWDER

FIELD OF THE INVENTION

The present invention relates to a process for preparing a spherical copper fine powder having an average grain size ranging from 0.1 μm to a few μm , and this powder is utilized as a conductive powder which is the main component of a conductive paste.

BACKGROUND OF THE INVENTION

As a copper fine powder having a narrow particle size distribution, an average grain size ranging from 0.1 μm to a few μm , and a spherical form has an excellent pasting property and finely forms a thick film conductor when used in an electronic circuit, and also a copper fine powder having a spherical form can be formed into a fired film having a high density, so that the electric resistance can be reduced, such copper fine powders having the properties as described above have been required.

Various processes have been known to prepare such copper fine powders, among which a liquid phase reduction precipitation process is employed as a method industrially practiced as well. This method comprises adding a reducing agent in a liquid phase containing copper ion and stirring the mixture to precipitate the metal powder directly in the liquid phase, and its examples include methods using reducing agents such as formalin (Japanese patent publication No. 76003/1980), hydrazine (Japanese patent publication No. 155302/1982) and sodium borohydride or dimethylamine borane (Japanese patent publication No. 224103/1983), and a method of reduction by hydrogen gas under pressurized condition (Japanese patent publication No. 22395/1968, Japanese patent publication No. 26727/1969), each of which affords a spherical or granular powder of several hundreds of μm to a few μm .

The copper fine powders prepared by those methods have considerably narrow particle size distributions and thus powders suitable for pasting can be frequently obtained, but the problems posessed by these methods are that a method having the better grain size and the better form controlling property requires the more expensive reducing agent and the production cost is high because of using a batch system reactor.

Also a method of reducing an oxide in a solid state has been known, but as this method generally results in large grain size and is affected by the form of the oxide, powders having the above properties are difficult to prepare.

Recently, a process for preparing superfine powders by means of a method of evaporation in gas or a fused metal reaction method using hydrogen arc plasma have been proposed, but these methods relates to superfine powders of a maximum of about 0.1 μm and have a disadvantage in which the powder is difficult to make into a paste when it is too superfine.

A process for preparing fine powders by means of a method of reducing a metal halide (vapor phase chemical reaction process, a kind of CVD) (Japanese patent publication 7765/1984) has been also proposed, but according to this method, the obtained powder is granular (in most cases, cubically shaped) in the fine powder zone of 0.1 μm or more. However, the vapor phase chemical reaction process has an advantage in which the used reactor is of a continuous system.

SUMMARY OF THE INVENTION

An object of the present invention is to provide a process by which spherical powders can be obtained both in the superfine powder zone (less than 0.1 μm) and in the fine powder zone (0.1 μm or more), by improving the method using a continuous reactor in the method for preparing copper powders having excellent properties as described above, and employing the chemical vapor phase reaction process suitable for mass production.

The present invention comprises evaporating cuprous chloride, feeding this into a reaction part by the vapor pressure of itself or by using an inert gas as a carrier, and contacting and mixing the cuprous chloride with a reducing gas (hydrogen) in the reaction part. This reaction part generally has a nozzle in the center part inside the tube reactor, and the two gases are contacted at the outlet of the nozzle, and then mixed and react, moving into the outlet with precipitating the powder. In this case, the space to mix the both gases is maintained at a temperature of 900° C. to less than 1150° C.

DETAILED DESCRIPTION OF THE INVENTION

Figure 1:
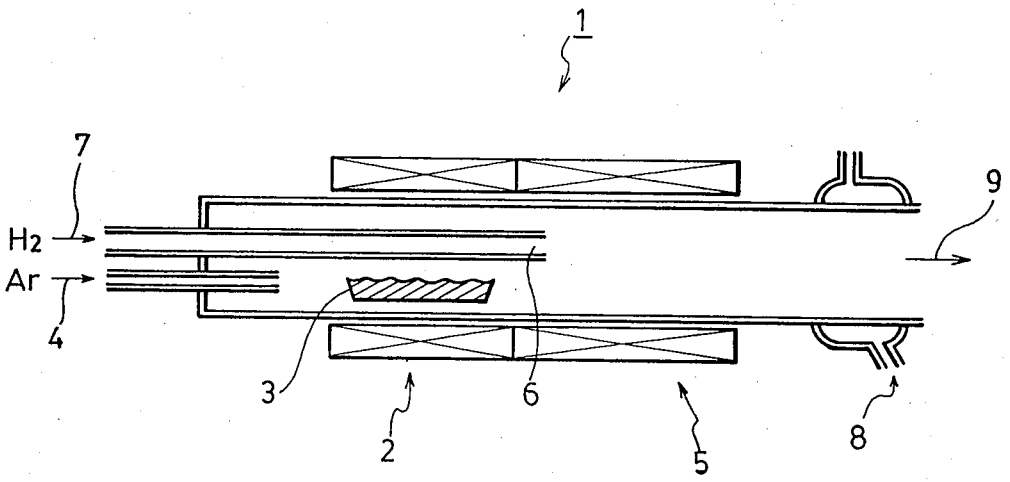
FIG. 1 is a longitudinal sectional view of a reactor which can be preferably used to practice the present invention.

In the vapor phase chemical reaction process, the growth of grains are considered as follows (Funtai Kogaku-Kaishi, Vol. 21, pp. 759–767 (1984)).

The moment a metal halide vapor is contacted with a reducing gas, monomers of the metal atom or cluster are formed, which collide and coalesce to form a superfine grain. The grain growth is further caused by collision, coagulation and coalescence of the superfine grains each other. The superfine grains are spherical, but they are often found to be polyhedrons having no edge or angle by more careful observations. When the grain is particularly in the superfine powder zone, the ratio of the surface energy is reduced, often showing crystal habit, so that it has been reported that the grain takes a cubic form when it is 0.1 micron or more, but the present invention has succeeded in obtaining spherical fine powders by selecting the reaction temperature suitable for the material to be prepared.

The reduction reaction by hydrogen of cuprous chloride is possible at 425° C. which is a melting point of cuprous chloride and the reduction has been conventionally conducted at a temperature of about 500°–700° C., but the limitation of 900° C. or more herein is experimentally decided as a condition to conduct the reaction in vapor phase and grow the grain under a fused condition or condition close thereto. As the powder obtained at a reaction temperature of less than 900° C. is a superfine powder having 0.1 micron or less and also contains a considerable amount of copper chloride, owing to insufficient conversion resulting from low reaction rate, it is significant to limit the temperature to 900° C. or more.

As the reduction reaction by hydrogen of cuprous chloride is an exothermic reaction, the temperature of the gas has a possibility to increase by the reaction to more than the melting point, even if the temperature of the outer wall of the reactor is lower than the melting point of copper (1083° C.).

When the reaction is proceeded at the melting point or a temperature close thereto, growth of the grain by cohesion also proceeds in a spherical from, resulting in maintaining the spherical form also when cooled.

On the other hand, the upper limit of the reaction temperature is decided as 1150° C. to avoid that the reaction at more than this temperature causes combination of large grains each other as the sufficiently grown grains are also liquid drops, forming grains which are too large against the average grain size as well, resulting in extension of the size distribution.

Also from this temperature the conversion begins to decrease eminently because the equilibrium of the reduction of cuprous chloride vapor is unfavored by the increase of temperature.

In order to grow the grain size, the evaporation temperature of copper chloride should be made sufficiently high to increase the vapor concentration of the copper chloride.

The superfine grains formed by the reaction collide by the Brown motion and grow with coalescing each other, in the process of which the copper fine powder as it remains spherical is formed by maintaining the growth even if it is close to the fine powder zone and the forced cooling. In this case, the spherical form is maintained by rapid cooling. The cooling rate of the present method is 1500 deg/sec or more. The average grain size is mainly controlled by the evaporation temperature of cuprous chloride and the evaporation temperature of 800° C. or more is required to make 0.1 μm or more, although it varies depending on the flow rate of the carrier gas.

The present invention has an effect that a copper fine powder extremely preferred as a conductive paste can be prepared at low cost.

EXAMPLE 1

Using a reactor 1 as shown in FIG. 1, about 5 g of cuprous chloride was put into a quartz boat 3 of an evaporation part 2 and evaporated at 900° C., argon gas was fed into a reaction part 5 maintained at 1000° C. as a carrier gas 4 at 4 liters/min, and hydrogen gas 7 was fed through a center nozzle 6 at 2 liters/min. The formed copper fine powder 9 was passed through a water-cooling part 8 and then recovered by an cylindrical filter to collect 1.35 g of a copper fine powder. The specific surface area of the obtained copper fine powder was 4.8 square meters/g, and the powder was found to be a spherical fine powder having an average grain size of 0.1 μm observed by the electron microscopy.

EXAMPLE 2

Figure 2:
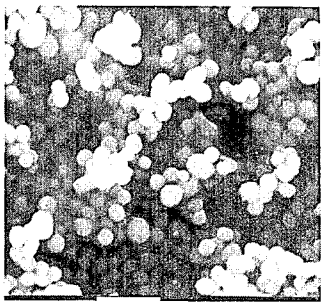
FIGS. 2 and 3 are microscopic photographs showing the form of the grain of a copper fine grain prepared according to the present invention.
Figure 3:
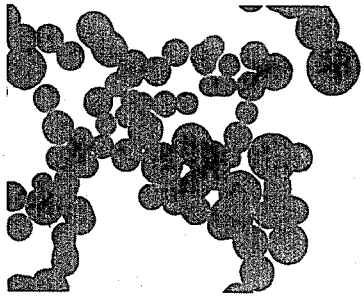

When the same procedure as in the above Example 1 was conducted using the evaporation temperature and reaction temerature of 1000° C. each, the flow rate of the carrier gas of 1 liter/min, and the flow rate of the hydrogen gas 7 of 0.5 liter/min, the obtained copper fine powder had a specific surface area of 3.0 square meters/g, and the average grain size calculated from the electron microscopy was 0.2 μm. These are shown by a scanning microscopic photograph of 10000 magnifications and a transmittant electron microscopic photograph of 25000 magnifications in FIGS. 2 and 3, respectively. The copper powder is found to have a spherical form and a narrow size distribution. The powder is extremely preferred as filler powders for a paste.

COMPARATIVE EXAMPLE 1

Figure 4:
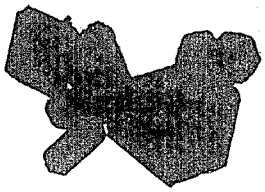
FIG. 4 is a microscopic photograph showing the form of the copper powders according to a comparative example.

Under conditions of the evaporation temperature and reaction temperature of 1000° C. each, the argon flow rate of 2 liters/min and the hydrogen flow rate of 1 liter/min, a copper powder was prepared using the reactor having no water-cooling part 8 in FIG. 1. The powder had an average grain size of 0.3 μm, and was a globule exhibiting crystal habit as shown by a transmittant electron microscopic photograph of 25000 magnifications in FIG. 4. Under this preparation condition, the cooling rate was about 1000 deg/sec.

COMPARATIVE EXAMPLE 2

The copper fine powder was prepared using the same conditions except a reaction temperature of 800° C. in the same equipment as in the above examples, and a superfine powder having a specific surface area of 13 square meters/g (0.1 μm or less) was obtained. This powder contained a considerable amount of copper chloride according to the X-ray diffraction.

COMPARATIVE EXAMPLE 3

When the reaction temperature was changed to 1150° C. in the same equipment as in the above examples, a fine powder having an average grain size of 0.5 μm was obtained, with which several % of grains having a size of 1 μm or more were mixed, and the size distribution was extended. The powder contained 5% of unreacted cuprous chloride.

What is claimed is:

1. A process of making fine, spherical copper powder comprising the steps of introducing a gaseous mixture of a reducible copper compound and an inert gas into a vapor deposition zone to contact a reducing gas; maintaining the zone at a temperature ranging from 900° C. to less than 1150° C. to generate fine, spherical copper particles; quenching the generated particles.

2. A process claimed in claim 1 which further comprises determining a combination of an evaporation temperature of cuprous chloride and a flow rate of the inert gas for obtaining an average grain size ranging from 0.1 μm to a few μm .

3. A process claimed in claim 1 which comprises quenching the generated particles at a rate of more than 1500 deg/sec, whereby the particles remain as a generated state of spherical shape.

* * * * *